United States Patent [19]

Yoshida

[11] Patent Number: 5,010,800

[45] Date of Patent: Apr. 30, 1991

[54] ELECTRONIC MUSICAL INSTRUMENT CAPABLE OF SELECTING BETWEEN FRET AND FRETLESS MODES

[75] Inventor: Satoshi Yoshida, Hamura, Japan

[73] Assignee: Casio Computer Co., Ltd., Tokyo, Japan

[21] Appl. No.: 407,226

[22] Filed: Sep. 14, 1989

[30] Foreign Application Priority Data

Sep. 20, 1988 [JP] Japan ..... 63-123102[U]

[51] Int. Cl.[5] ..... G10D 3/06; G10H 1/34

[52] U.S. Cl. ..... 84/646; 84/670; 84/742; 84/743; 84/DIG. 30

[58] Field of Search ..... 84/DIG. 30, 646, 722, 84/293, 613, 658

[56] References Cited

U.S. PATENT DOCUMENTS

| | | | |
|---|---|---|---|
| 4,235,141 | 11/1980 | Eventoff | 84/672 |
| 4,297,936 | 11/1981 | Mouton | 84/314 R |
| 4,336,734 | 6/1982 | Polson | 84/646 |
| 4,553,465 | 11/1985 | Kawashima et al. | 84/613 |
| 4,630,520 | 12/1986 | Bonano | 84/655 |
| 4,658,690 | 4/1987 | Aitken et al. | 84/629 |
| 4,665,788 | 5/1987 | Tripp et al. | 84/658 |
| 4,723,468 | 2/1988 | Takabayashi et al. | 84/722 |
| 4,748,887 | 6/1988 | Marshall | 84/646 |
| 4,805,510 | 2/1989 | De Dianous | 84/723 |

FOREIGN PATENT DOCUMENTS

| | | |
|---|---|---|
| 85/02705 | 6/1985 | World Int. Prop. O. . |
| 87/00330 | 1/1987 | World Int. Prop. O. . |

*Primary Examiner*—William M. Shoop, Jr.
*Assistant Examiner*—Brian Sircus
*Attorney, Agent, or Firm*—Frishauf, Holtz, Goodman & Woodward

[57] ABSTRACT

An electronic muscial instrument for use in a stringed instrument such as a guitar, a guitar synthesizer or a violin. Two modes can be selectively set by a mode setting operation conducted on a mode setting section. Even if the same fingering operation is performed, a pitch designated by the fingering operation differs depending on which one of the two modes is currently set.

27 Claims, 7 Drawing Sheets

ELECTRONIC MUSICAL INSTRUMENT CAPABLE OF SELECTING BETWEEN FRET AND FRETLESS MODES

BACKGROUND OF THE INVENTION

1. Field of the Invention

The present invention relates to an electronic musical instrument, and more particularly, to an electronic musical instrument which can selectively execute a musical performance by a stringed instrument with frets such as a guitar and a musical performance by a fretless stringed instrument such as a violin.

2. Description of the Related Art

With recent rapid development of electronic techniques, electronic stringed instruments have been developed which can generate musical tones with multifarious timbres through the same picking operation as done with traditional natural stringed instruments. A string trigger type electronic stringed instrument is one of such electronic stringed instruments. This electronic stringed instrument detects the fret position of a string, presently depressed, by means of a pitch designation status detector provided on the fingerboard side, to thereby designate a corresponding pitch, detects the status of a picking operation conducted on a string by means of a string trigger sensor provided on the body side, and generates a musical tone with a given timbre from this string trigger sensor at the pitch designated by the pitch designation status detector. The feature of this string trigger type electronic stringed instrument lies in its simple structure according to which the beginning of string vibration is detected by the string trigger sensor, a musical tone is generated upon this detection, and the pitch of the musical tone to be generated is determined by a pitch designation signal from the pitch designation status detector.

Traditional natural stringed instruments are classified into two types; the first type is an acoustic guitar or the like which has frets provided on the fingerboard, and the other is a violin or the like which has no frets provided on the fingerboard. Accordingly, two types of electronic stringed instruments, namely, an electronic stringed instrument with frets and a fretless electronic stringed instrument, have been developed. The former type has fret status detecting means for each of a number of frets provided on the fingerboard. This type of electronic stringed instrument is disclosed in, for example, U.S. Pat. Nos. 4,235,141, 4,336,734, 4,630,520, 4,658,690 and 4,723,468. The latter type of electronic stringed instrument has belt-shaped pitch status detecting means provided on the fingerboard, and this means comprises a number of switches. This electronic stringed instrument is disclosed in U.S. Pat. No. 4,805,510, for example.

According to the conventional fret type electronic stringed instrument, however, one fret status detecting means is simply provided for each fret, so that only one pitch is set by one fret status detecting means. If, with one fret being depressed, the fingering position at the fret position is slightly or finely changed, the pitch of a musical tone to be generated cannot be finely altered in accordance with the change in fingering position. In other words, this type of electronic stringed instrument has a shortcoming such that it cannot produce the same vibrato effect as obtained by performing a vibrato operation on a so-called violin type stringed instrument which has no frets on the fingerboard.

According to the conventional fretless electronic stringed instrument, fingering positions are detected by the aforementioned many pitch status detecting means. When a finger tip is moved within a range corresponding to the same fret position, therefore, the pitch of a musical tone to be generated is slightly changed in accordance with the finger movement. Although this instrument can produce the aforementioned vibrato effect of a violin type stringed instrument, it cannot provide the same musical effect as obtained by a fret-using stringed instrument, such as a guitar.

SUMMARY OF THE INVENTION

Accordingly, it is an object of this invention to provide an electronic musical instrument which can selectively execute a musical performance by a fret-using stringed instrument such as a guitar and a musical performance by a fretless stringed instrument such as a violin.

It is another object of this invention to provide an electronic musical instrument which has mode setting means to selectively set this instrument in a mode for a fret-using electronic musical instrument or a mode for a fretless electronic musical instrument, easily and quickly.

According to one aspect of the present invention, there is provided an electronic musical instrument comprising:

a fingerboard having a fingering operation area over which a player performs a fingering operation;

mode setting means for setting a first mode for dividing the fingering operation area into a plurality of first pitch designation regions in predetermined pitch units, and a second mode for dividing each of the first pitch designation regions into a plurality of second pitch designation regions in pitch units smaller than the predetermined pitch units; and pitch designating means for, when any one of the plurality of first pitch designation regions is subjected to a fingering operation in the first mode set by the mode setting means, designating a pitch assigned to the first pitch designation region subjected to the fingering operation, and for, when any one of the plurality of second pitch designation regions is subjected to a fingering operation in the second mode set by the mode setting means, designating a pitch assigned to the second pitch designation region subjected to the fingering operation.

The fingerboard may or may not be provided on an instrumen' body. The mode setting means may be provided on or outside the instrument body. When the mode setting means is provided on the instrument body, it is desirable that the mode setting operation of the mode setting means be executed by a fret operation by a player. Although it is desirable that at least one string be stretched on the fingerboard, no strings should not necessarily be stretched. It is desirable that the fingerboard has a plurality of frets provided thereon as marks for dividing the fingering operation area into a plurality of first pitch designation regions. Although the frets should desirably be provided protrusively on the fingerboard, they are not restricted to have such a shape; the frets may be lines or patterns. The first mode is a fret mode and the second mode is a fretless mode, and it is desirable that the predetermined pitch units are half-tone units. Further, the pitch designating means may comprise a plurality of pitch designation switches provided respectively for the plurality of second pitch designation regions, and means for, when any one of the pitch designation switches is operated, designating a pitch associated with the operated pitch designation switch. The pitch designating means is not restricted to the above structure; it may be designed as disclosed in, for example, U.S. Pat. No. 4,723,468, in such a way that the reflection time of an ultrasonic echo reflecting from a fingering operation position is measured and a pitch is designated on the basis of the measured time.

According to another modification, in addition to the above-described mode setting means and pitch designating means, the above electronic musical instrument has tone generating means for generating a musical tone having a pitch designated by the pitch designating means in response to detection of string vibration. The tone generating means comprises string vibration detecting means for detecting vibration of at least one string stretched and means for generating a musical tone having a pitch designated by the pitch designating means in response to the detected string vibration. The tone generating means may or may not be provided on an instrument body having the fingerboard.

According to another aspect of this invention, there is provided an electronic musical instrument comprising:

a fingerboard having a fingering operation area over which a player performs a fingering operation;

mode setting means for setting a first mode for dividing the fingering operation area into a plurality of first pitch designation regions in predetermined pitch units, and a second mode for dividing each of the first pitch designation regions into a plurality of second pitch designation regions in pitch units smaller than the predetermined pitch units; and pitch designating means for, when a fingering operation position is changed within a specific first pitch designation region of the plurality of first pitch designation regions in the first mode set by the mode setting means, designating a same pitch as assigned to the specific first pitch designation region irrespective of a change in fingering operation position, and for, when the fingering operation position is changed to a specific second pitch designation region in the plurality of second pitch designation regions in the second mode set by the mode setting means, newly designating a pitch assigned to the specific second pitch designation region in response to a change in fingering operation position.

According to a further aspect of this invention, there is provided an electronic musical instrument comprising:

mode setting means for selectively setting a fret mode and a fretless mode;

position detecting means for detecting a fingering operation position with respect to a fingering operation area; and pitch designating means for, when the position detecting means detects a change in fingering operation position within a specific region of the fingering operation area in the fret mode set by the mode setting means, designating a same pitch as assigned to the specific region irrespective of a change in fingering operation position, and for, when the position detecting means detects a change in fingering operation position within a specific region of the fingering operation area in the fretless mode set by the mode setting means, designating different pitches within a pitch assigned to the specific region in accordance with a degree of the change in fingering operation position.

DETAILED DESCRIPTION OF THE PREFERRED EMBODIMENTS

Preferred embodiments of the present invention will now be described referring to the accompanying drawings.

Figure 1:
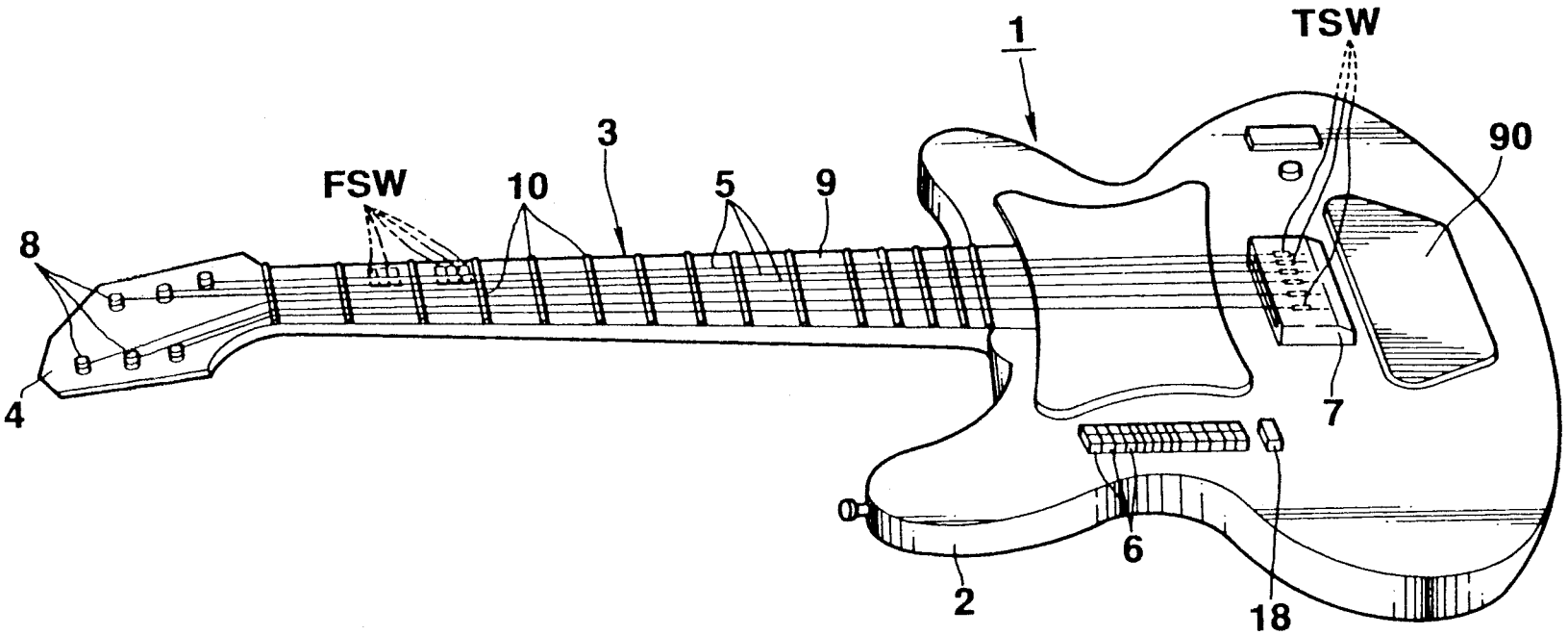
FIG. 1 is a general perspective view of an electronic stringed instrument according to one embodiment of the present invention.

FIG. 1 presents the general external view of an electronic stringed instrument according to one embodiment of this invention.

Referring to FIG. 1 an electronic stringed instrument 1 comprises a body 2, a neck 3 and a head 4, and has a guitar shape. A plurality of strings 5 are stretched along the length of the neck 3 for playing a musical performance. The body 2 is provided with parameter switches 6 for setting various parameters, a mode select switch 18 serving as playing mode setting means to select between a fret mode (guitar mode) and a fretless mode, and a loudspeaker 90 for generating musical tones. The strings 5 each have one end supported by a peg 8 provided at the head 4 so that the string tension can be adjusted. The other end of each string 5 extends over a fingerboard 9 constituted by the top portion of the neck 3 and is secured inside a string trigger switch section 7 provided on the body 2. A plurality of pitch status detecting switches FSW the same number as or a greater number than the number of frets 10 aligned in the string-stretching direction on the top surface of the fingerboard 9 serving as pitch designation detecting means are provided on the fingerboard 9 along the length thereof. The frets 10 are provided on the top surface of the fingerboard 9 in a direction normal to the string-stretching direction of the strings 5. When a region between adjacent frets is depressed with a finger, etc., the associated pitch status detecting switch FSW is switched ON. The string trigger switch section 7 accommodates string trigger switches TSW. When the string 5 coupled to the respective string trigger switches TSW are stroked or plucked, the switches TSW are switched ON and generation of musical tones starts. Since the frets 10 are used to specify a region having a constant pitch status when the fret mode (guitar mode) is selected by the mode select switch 18, their protruding height is made lower than that of the frets of a conventional acoustic guitar in order to avoid obstruction of a musical performance.

Figure 2:
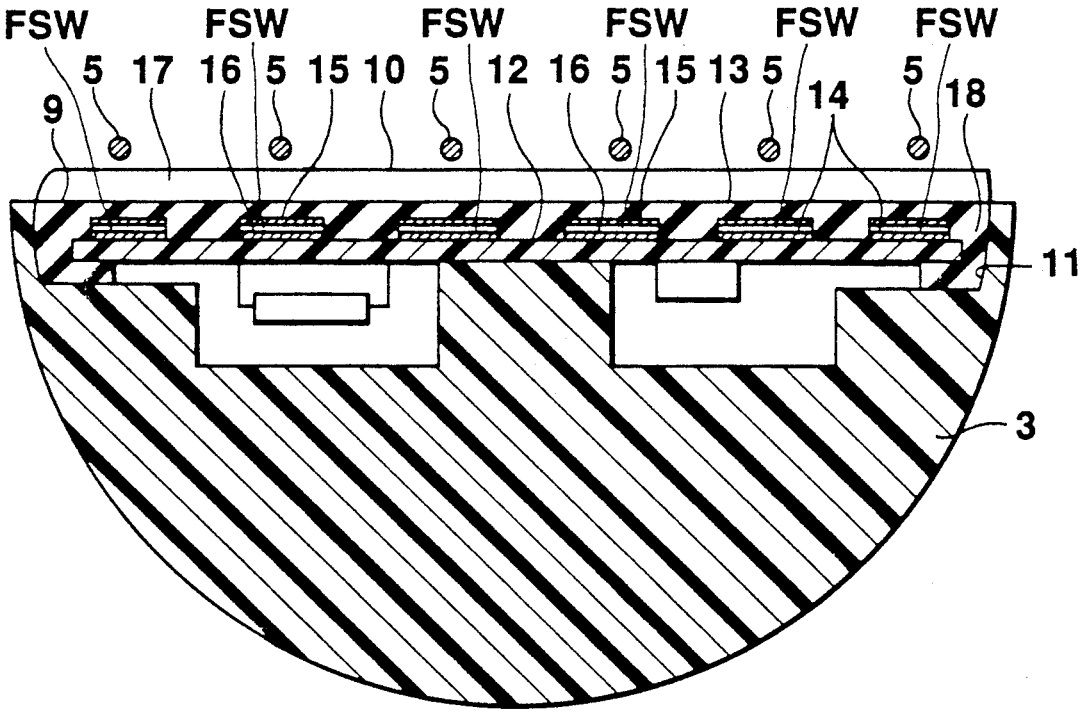
FIG. 2 is a cross sectional view of a neck illustrated in FIG. 1.
Figure 3:
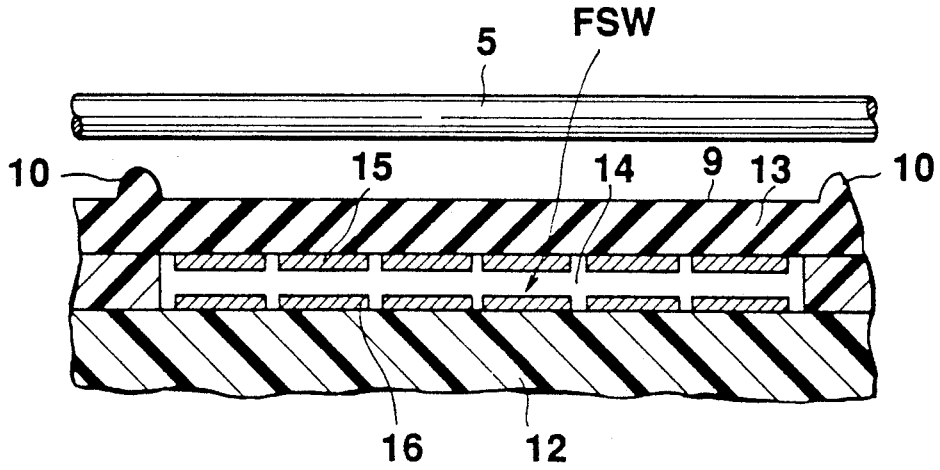
FIG. 3 is an enlarged cross sectional view of the portion of a pitch status detecting switch shown in FIG. 1.

The portion of each pitch status detecting switch FSW has a configuration as shown in FIG. 2. A printed circuit board 12 and a rubber sheet 13 are fit and secured in a recess 11 formed in the top surface of the neck 3 or the fingerboard 9. The rubber sheet 13 is disposed on, and adhered to, the printed circuit board 12. Both ends of the rubber sheet 13 are bent to have a ]-shaped cross section so as to envelope both ends of the printed circuit board 12 and secure the board 12. As shown in FIG. 3, a row of contact recesses 14 are formed at that portion of the bottom surface of the rubber sheet 13 adhered to the top surface of the printed circuit board 12 in the lengthwise direction of the neck 3 per region corresponding to each string 5 (amplitude range of the string). (For a 6-string instrument such as a guitar, there are six rows.) Electrodes 15 serving as movable contacts are formed to have a pattern on the bottom surface of each recess 14, and electrodes 16 serving as fixed contacts are formed on those portions of the printed circuit board 12 which face the electrodes 15. The electrodes 15 and 16 constitute the pitch status detecting switches FSW for designating a predetermined pitch. When the string 5 is depressed against the rubber sheet 13 or the surface of the fingerboard 9, the electrode 15 contacts the electrode 16, thus turning the pitch status detecting switch FSW ON.

Figure 4:
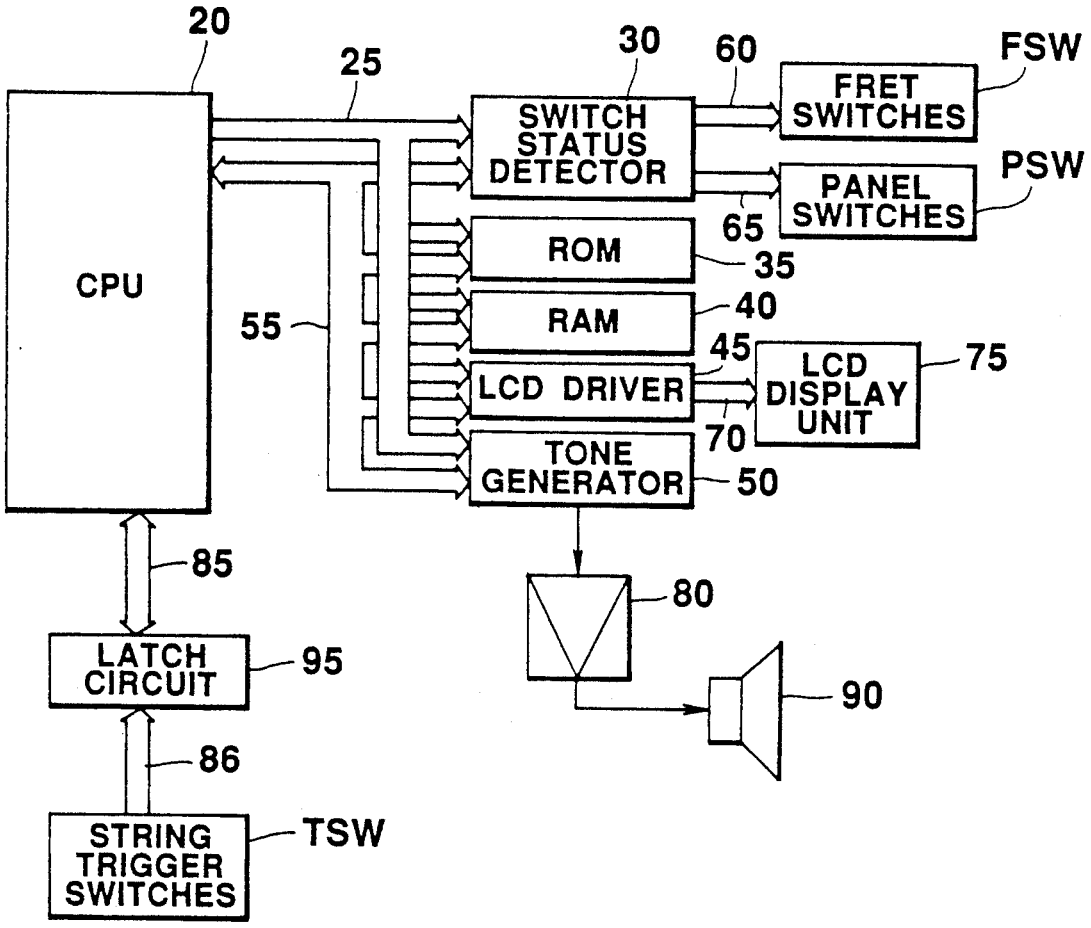
FIG. 4 is a block diagram illustrating an example of the configuration of an electronic circuit for use in the electronic stringed instrument shown in FIG. 1.

FIG. 4 illustrates the configuration of the general circuit of the electronic stringed instrument having the pitch status detecting switches FSW and panel switches PSW.

Referring to FIG. 4, a CPU 20 is coupled via an address bus 25 with a switch status detector 30, a ROM 35, a RAM 40, an LCD driver 45 and a tone generator 50. Data from these components is sent over a data bus 55 to the CPU 20. The switch status detector 30 is coupled to the pitch status detecting switches or fret switches FSW via a bus line 60, and to the panel switches PSW via a bus line 65. The LCD driver 45 is coupled via a bus line 70 to an LCD display unit 75. A musical tone signal generated from the tone generator 50 is produced as a sound from the loudspeaker 90. The CPU 20 is coupled via a bus line 85 to a latch circuit 95 to which the string trigger switches TSW are connected via a bus line 86.

An ON input signal output from the string trigger switches TSW, which are rendered ON when the respective strings are stroked or plucked, is latched by the latch circuit 95. The CPU 20 detects the triggering of the strings 5 through the latch circuit 95. Switch status data of each pitch status detecting switch FSW and input status data of each panel switch PSW (parameter setting switch 6 shown in FIG. 1) are input to the switch status detector 30, and are loaded into the CPU 20 via this detector 30. The tone generator 50 generates a musical tone signal corresponding to a musical tone specified by the CPU 20, under the control of the CPU 20. The musical tone signal is amplified by an amplifier 80 and is produced outside as a sound from the loudspeaker 90.

Figure 5:
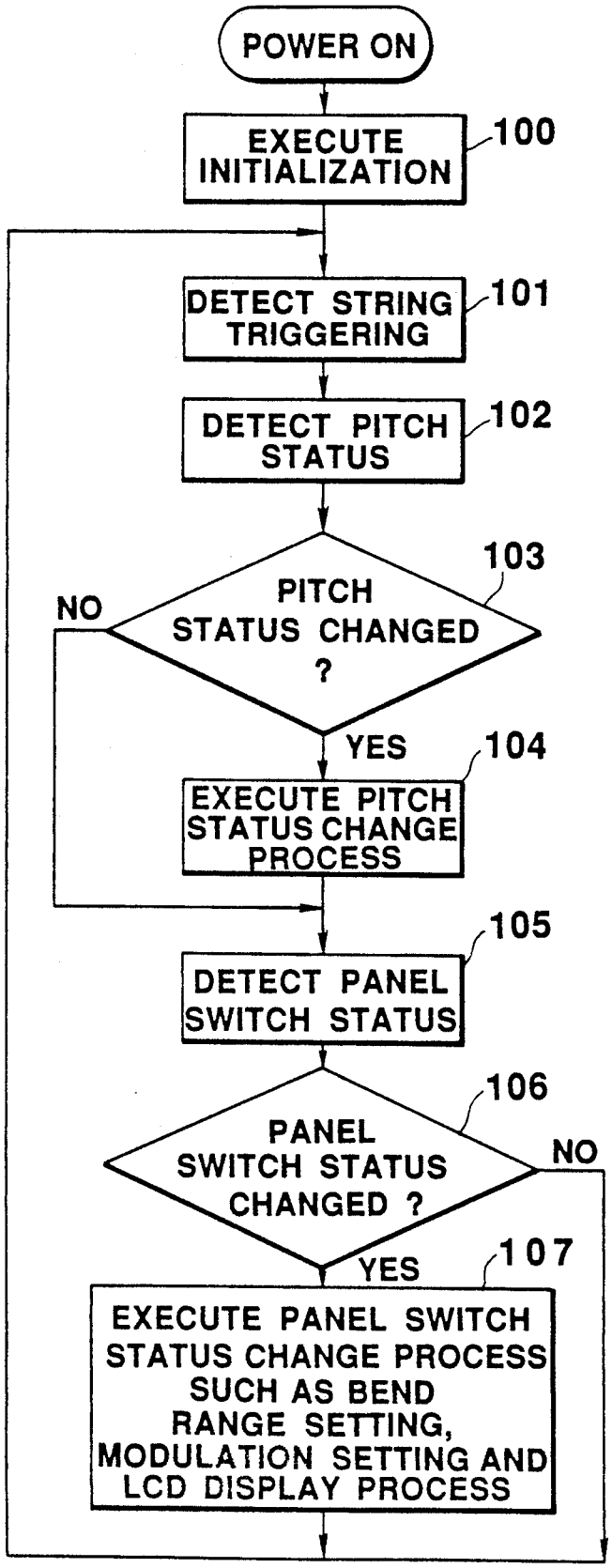
FIG. 5 is an operational flowchart for the circuit shown in FIG. 4.

The arithmetic operation of the CPU 20 shown in FIG. 4 will now be described referring to the flowchart shown in FIG. 5.

When power is turned ON, the CPU 20 performs an initialization in step 100 and then advances to step 101. In this step 101 the CPU 20 reads out data latched in the latch circuit 95 (see FIG. 4) and discriminates the presence/absence of string triggering for every string 5 (see FIG. 1) or the presence/absence of detection of a picking operation status, i.e., whether or not a string picking operation is performed. When triggering of any string 5 is detected in this step 101, the CPU 20 controls the tone generator 50 to generate a musical tone. The CPU 20 then executes a pitch status detecting process in step 102. More specifically, the CPU 20 detects the switch status of each pitch status detecting switch FSW through the switch status detector 30 (FIG. 4). In the next step 103 the CPU 20 discriminates whether or not the present pitch designation status of each pitch status detecting switch FSW differs from the previous one. If it is discriminated in this step 103 that no change is made between and the present and previous pitch designation statuses, the flow advances to step 105. If it is discriminated in step 103 that the present pitch designation status differs from the previous one, however, a pitch change process is executed in step 104 before the flow advances to step 105. A note-off operation will be performed when any pitch status detecting switch FSW belonging to those strings which are presently generating musical tones, is released or when the string status is changed to a so-called open string status. When the pitch designation status is changed to a status in which any pitch status detecting switch FSW belonging to those strings which are presently generating no musical tones, nothing will be performed. In the above manner, the CPU 20 discriminates in the pitch designation status change process of step 103 whether or not the pitch designation status has been changed.

In step 105, the CPU 20 reads data of the statuses of the individual parameter setting switches of the panel switches PSW shown in FIG. 4, through the switch status detector 30. In step 106, it is discriminated whether or not the status of each parameter setting switch of the panel switches PSW detected in step 105 has changed. If the decision in step 106 is negative, the flow returns to step 101. If the decision in step 106 is affirmative, a parameter status change process is executed in step 107. This process of step 107 includes a process of setting a timbre, modulation data and a bend range, an LCD display process, etc.

Figure 6:
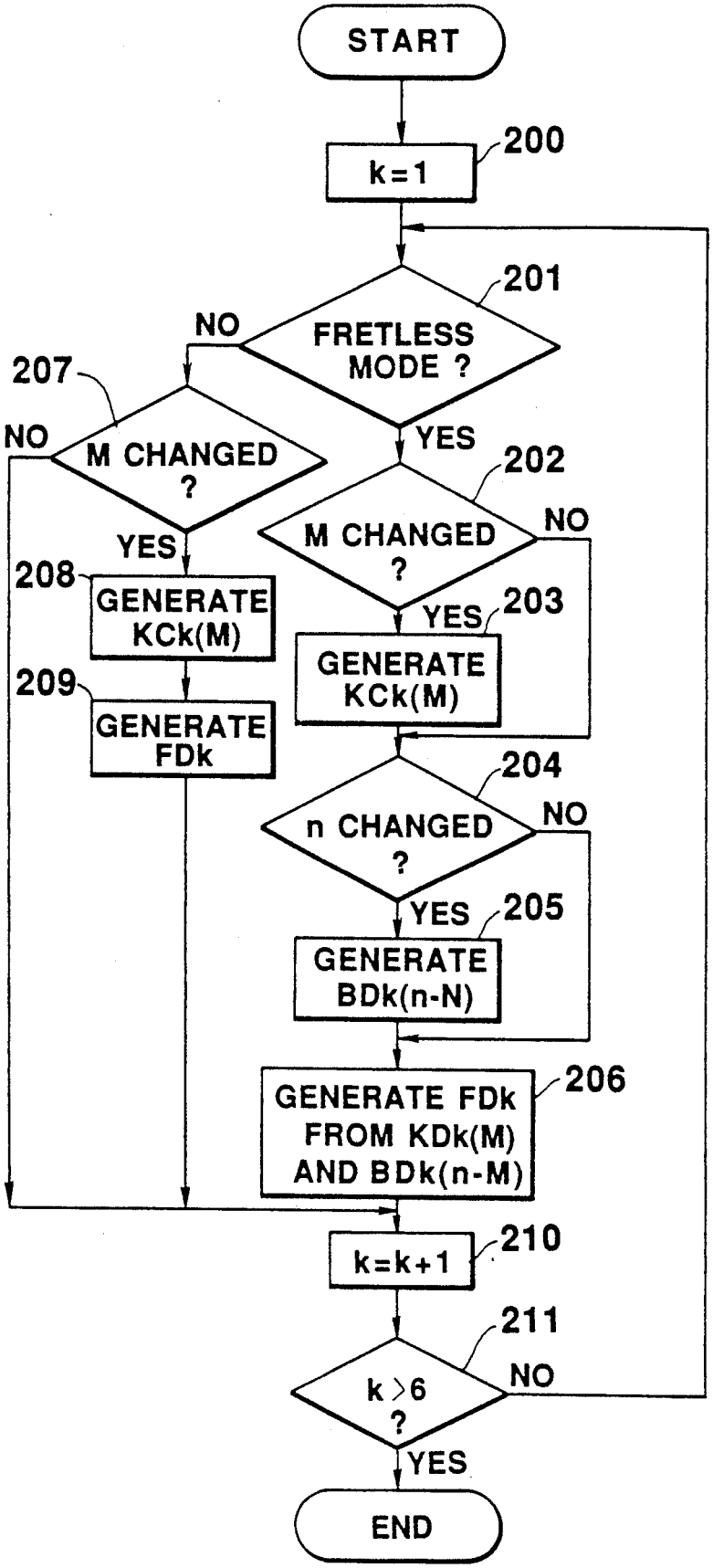
FIG. 6 is a flowchart for executing a pitch status change detecting process shown in FIG. 5.

Referring to the flowchart shown in FIG. 6, a description will now be given of the process from the pitch designation status detection to musical tone change of the above process sequence when the mode select switch 18 (FIG. 1) is set to either the fret mode or fretless mode and the pitch designation operation position is changed in the string-stretching direction in the selected mode. Before describing this process, the relation between fret switches and frets will be explained with reference to an electronic stringed instrument using six strings.

Figure 7:
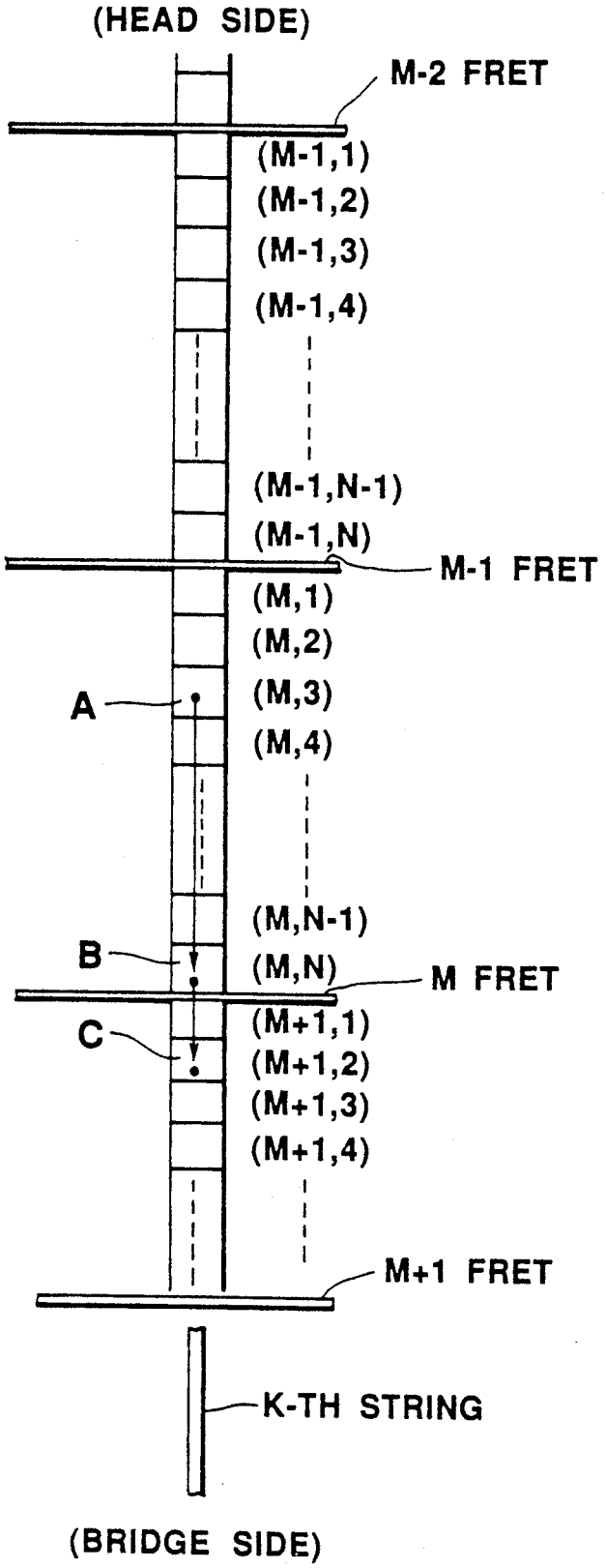
FIG. 7 is a diagram for explaining the flowchart illustrated in FIG. 6.

For every string of the electronic stringed instrument 1, a process with respect to the pitch designation status of each string is executed. As illustrated in FIGS. 1-3, the electronic stringed instrument 1 has the contact recesses 14 formed for each fingering operation area (amplitude range) of each string in the lengthwise direction of the neck 3 or the string-stretching direction. (Six rows of contact recesses 14 would be formed for a 6-string instrument such as a guitar.) Fret switches for detecting pitch designation statuses are provided in the contact recesses 14. Each pitch designation row is divided into plural groups (M) of frets by a plurality of frets 10 arranged in the lengthwise or string-stretching direction of the neck 3 (FIG. 1) as shown in FIG. 7. That is, M blocks of frets are produced.

The process from the detection of the pitch designation status to tone change process will now be described according to the flowchart shown in FIG. 6.

First, in step 200, a string (string number is denoted by k) is designated. That is, from six strings, the first string (k=1) is designated. In the next step 201 it is discriminated whether or not the mode select switch 18 serving as mode setting means is set for the fretless mode, i.e., it is discriminated whether the mode select switch 18 is set to the fret mode or fretless mode.

The above process will be described below separately in two cases: the fretless mode and fret mode.

In Fretless Mode

If it is discriminated in step 201 that the mode select switch 18 is set for the fretless mode, the individual fret switches in the pitch designation row (frets provided along the k-th string shown in FIG. 7) of the number of the number of the first string (k-th string in FIG. 7) designated in step 200 are scanned in the next step 202. Through the fret scanning, it is discriminated whether or not the statuses of the fret switches have changed. In other words, it is discriminated whether or not a change has occurred in M fret block, M−1 fret block and M−2 fret block shown in FIG. 7. For instance, if in step 202 the position A between the M fret and M−1 fret is pressed and the pitch status detecting switch FSW (M, 3) lying at the position A is switched ON as a consequence, it is discriminated that a change has occurred in the M fret block to which that pitch status detecting switch FSW belongs. For instance, if the position of the pitch status detecting switch FSW pressed is changed from A (the previously pressed) to B in the M fret block and the pitch status detecting switch FSW (M, N) lying at B is switched ON, it is discriminated that no change has occurred in the M fret block since the M fret block to which the previously-pressed pitch status detecting switch FSW (M, 3) is the same as the M fret block to which the presently-pressed pitch status detecting switch FSW (M, N). If the position of the pitch status detecting switch FSW pressed is changed from A in the M fret block (FIG. 7) to C in a M+1 fret block and the pitch status detecting switch FSW (M+1, 2) lying at C is switched ON as a consequence, it is discriminated that a change has occurred in fret blocks (from the M fret block to the M+1 fret block) since the fret blocks to which the previously-pressed and presently-pressed pitch status detecting switches FSW belong differ from each other.

If it is discriminated in step 202 that a change has occurred in the fret blocks to which the pressed pitch status detecting switches FSW belong, key code data KCk associated with the fret block in which the change has occurred is produced in step 203. The first key code data KCk produced in step 203 when the previous fret block is changed to a new one, is a key code predetermined as a reference with respect to the new fret block. That is, the key code data KCk produced in step 203 is determined by a fret block number. In a case where the previous fret block number is M−1 or M+1, for example, and it is changed to M, when the first pitch designation status position is A or B in FIG. 7, the same key code data KCk would be produced fro the positions A and B since A and B belong to the same fret blocks.

If it is discriminated in step 202 that no change has occurred in fret block (e.g., M fret block in FIG. 7), the previously produced key code data KCk is held and the flow advances to step 204.

If new key code data KCk is produced in step 203, the flow advances to step 204 where it is discriminated whether or not a change has occurred in any pitch status detecting switch FSW in the M fret block, i.e., whether or not the pitch designation position in the M block has changed.

For instance, if no change has occurred both previously and presently in any switch FSW in the M fret block, i.e., if the pressed pitch status detecting switch FSW is changed from FSW (M, 3) at the position A in the M fret block to FSW (M, N) at the position B and the switch FSW (M, N) is switched ON, it is discriminated that a change has occurred in pitch designation position since the switch FSW is changed within the same M fret block. If the pressed pitch status detecting switch FSW is changed from FSW (M, 3) at the position A in the M fret block (FIG. 7) to FSW (M+1, 2) at the position C in the M+1 fret block and the latter switch FSW (M+1, 2) is rendered ON, it is discriminated in step 204 that no change has occurred in pitch designation position although it is discriminated in step 202 that a change has occurred between fret blocks.

If it is discriminated in step 204 that the presently pressed pitch status detecting switch FSW differs from the previously pressed one, bend data BDk (n−N) corresponding to the pitch designation position associated with the new switch FSW is produced in step 205. The generation of the bend data BDk (n−N) in step 205 will now be described with reference to a case where the pitch $f_0$ (reference pitch) for the previous pitch status detecting switch FSW (M, 3) at the position A (see FIG. 7) is changed to the pitch for the present pitch status detecting switch FSW (M, N) at the position B. The generation of the bend data BDk (n−N) is executed on the basis of the difference between the number of switches FSW present between the previous pitch status detecting switch FSW (M, 3) and another pitch status detecting switch FSW (M, N) in the same fret block (M fret block in FIG. 7) and the total number N of the switches FSW in the M fret block (a constant pitch range the M fret block can have). This total number N is, for example, the total number of switches FSW existing between the pitch limit in the M−1 fret block adjacent to the M fret block and the pitch limit in the M+1 fret block.

After generation of the bend data BDk (n−N), the flow advances to step 206. If it is discriminated in step 204 that no change has occurred in pitch status detecting switch FSW in the same fret block (e.g., M fret block in FIG. 7), the previously produced bend data BDk is held as it is, and the flow advances to step 206.

If the bend data BDk is produced in step 205 or the previously produced bend data BDk is held, pitch data FDk is produced in step 206 from the key code data KDk produced in step 203 and the presently-produced bend data BDk. Upon generation of pitch data FDk in step 206, the flow advances o step 210. As a result, the pitch of a musical tone to be generated is changed to the one according to the pitch data FDk.

In Fret Mode

A description will now be given of a case where the mode select switch 18 is set to the fret mode (guitar mode) in step 201.

First, in step 207 it is discriminated whether a change has occurred in pitch status detecting switch FSW in the fret block in step 200 as in step 202. In this case, when, in an open string state, the pitch status detecting switch FSW (M, 3) at the position A in the M fret block (FIG. 7) is now rendered ON, it is discriminated that a change has occurred in the M fret block to which that pitch status detecting switch FSW belongs. Let us consider a case where the fret operation position is moved to the position B of the pitch status detecting switch FSW (M, N) from the position A of the previously-pressed pitch status detecting switch FSW (M, 3). In this case, since the fret operation position is changed in the same M fret block, it is discriminated that no change has occurred in the M fret block. In contrast, let us consider a case where the fret operation position is changed to the position C of the pitch status detecting switch FSW (M+1, 2) in the M+1 fret block from the position A of the pitch status detecting switch FSW (M, 3) and the switch FSW (M+1, 2) is rendered ON. In this case, since the fret operation position is changed to the M+1 fret block from the M fret block, it is discriminated that a change has occurred in the M+1 fret block to which the switch FSW (M+1, 2) belongs (from the M fret block to the M+1 fret block).

If it is discriminated in step 207 that a change has occurred in the fret block (e.g., from the M fret block to the M+1 fret block), key code data KCk (M+1) corresponding to the fret block (M+1 fret block) to which the presently-ON pitch status detecting switch FSW is produced in step 208. Upon production of the key code data KCk (M+1, 2) corresponding to the new fret block (M+1 fret block) in step 208, new pitch data FDk is produced on the basis of this key code data KCk (M+1, 2) and the pitch of a musical tone to be generated is changed to the pitch corresponding to this pitch data FDk in step 209. The flow then advances to step 210.

In guitar mode, as described above, the pitches designated by all the pitch status detecting switches FSW in the M fret block, for example, are the same. Even if the fret operation position is changed from the position A of the pitch status detecting switch FSW (M, 3) to the position B of the pitch status detecting switch FSW (M, N) in the same M fret block, therefore, the key code data KCk produced is the same even if the fret operation position is slightly changed by a fingering operation in the same fret block since the pitch data FDk is the same as the key code data KCk (M) in the M fret block.

When it is discriminated in step 207 that no change has occurred in fret block, the flow advances to step 210 without generating new pitch data FDk.

After the string number 1 corresponding to the first string is incremented by 1 (K=K+1) to be "2," it is judged in step 211 whether or not the present string number 2 is greater than 6. If the former number is discriminated to be smaller than 6, the process from steps 201 to 210 is repeated.

In step 211 it is discriminated whether or not the process has been executed for all the strings (6 strings). When the process for all the strings and all the pitch designation rows (fret blocks) is completed, the flow is completed. It should be noted that this flow is repeated in a given cycle.

Figure 8:
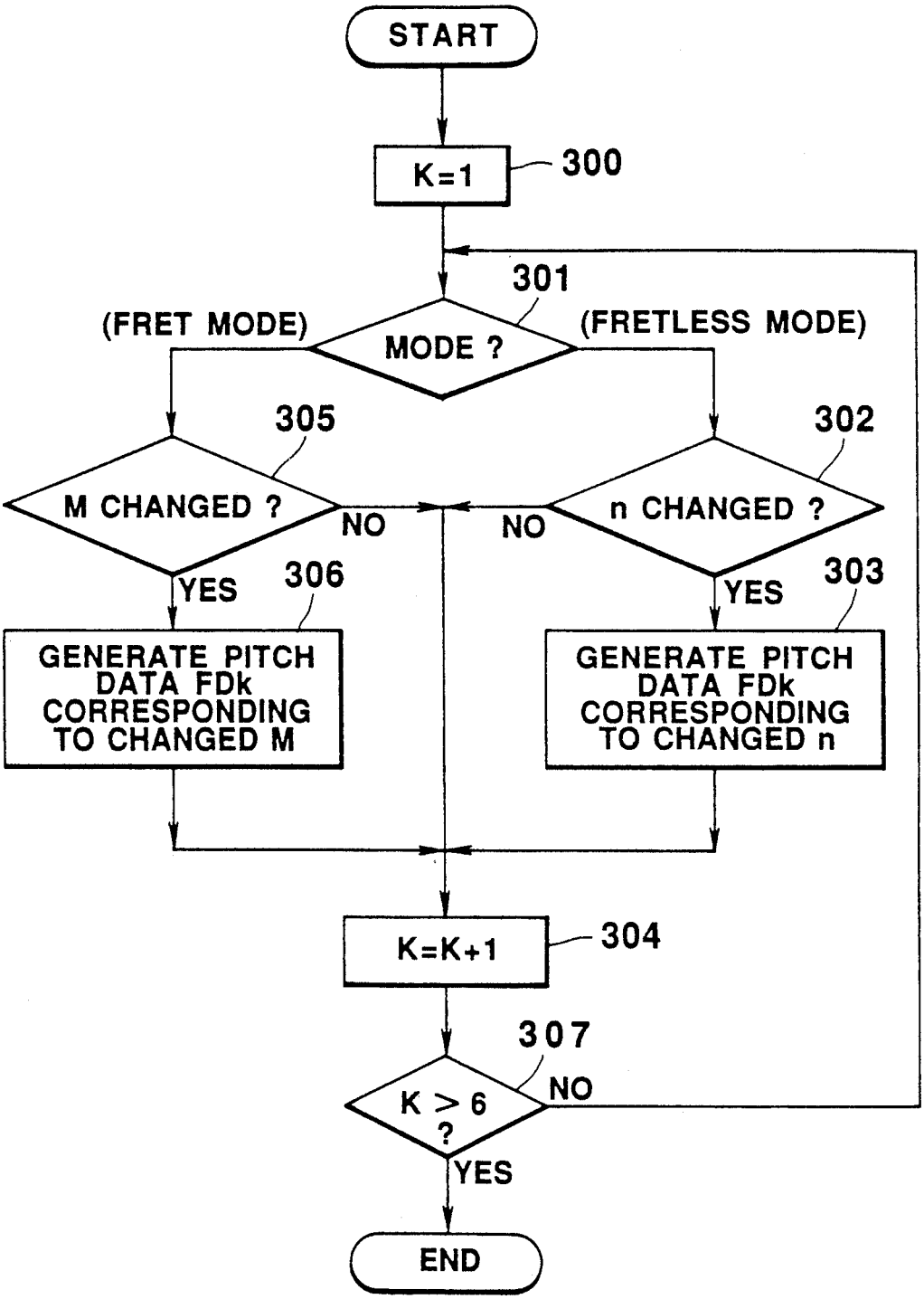
FIG. 8 is a flowchart for explaining an operation of another embodiment of the present invention.

FIG. 8 is a flowchart for explaining another embodiment of the present invention.

According to this embodiment, unlike the previous embodiment, even if a fingering operation is conducted on the same pitch designation region, different pitch data FDk is produced in accordance with the set mode and a pitch corresponding to this pitch data FDk is designated.

After the first string (K=1) is designated in step 300, it is discriminated in the next step 301 whether the presently set mode is the fretless mode or fret mode. If it is discriminated to be in fretless mode, the flow advances to step 302 where it is discriminated whether or not a change has occurred in fret switches. If it is discriminated that a change has occurred in a specific one of the fret switches FSW in this step 302, pitch data FDk (pitch data in units of cent finer than pitch data in units of half-tones) according to that fret switch is produced in the next step 303. Accordingly, the pitch corresponding to this pitch data FDk is designated. If it is discriminated in step 302 that no change has occurred in fret switches, the flow directly advances to step 304.

If it is discriminated in step 301 that the fret mode has been set, it is discriminated in the next step 305 whether or not a change has occurred in a specific one of the fret switches FSW. If it is discriminated that a change has occurred in the specific fret switch, pitch data FDk assigned to the fret switch group to which that fret switch FSW belongs (pitch data assigned for each fret block in half-tone units) is produced and the pitch corresponding to this pitch data FDk is designated. If it is discriminated in step 305 that no change has occurred in the fret switch FSW, the flow advances to step 304 without producing new pitch data FDk. The subsequence process (step 307) is the same as the one executed in the previous embodiment.

According to this embodiment, different pitch data FDk is produced depending on the mode set. That is, the pitch data FDk in units of cent finer than a half-tone unit is produced in fretless mode, while the pitch data FDk is produced in half-tone units in fret mode.

The foregoing description of the embodiments has been given with reference to a case where the strings are stretched over the fingerboard 9. These embodiments are in no way restricted to this particular design; the strings 5 may be provided only on the side of the body 2. Although the foregoing description of the embodiments has been given with reference to a plurality of frets 10 being formed on the fingerboard 9 in the lengthwise direction thereof at given intervals, the frets should not necessarily be formed on the fingerboard 9. Further, in the above embodiments, when a fingering operation is finely changed after a musical tone with the pitch designated by the individual fret switches FSW is temporarily generated in association with the ON state of the string trigger switches TSW, the frequency of the presently-generated musical tone is changed in accordance with the changed status. This change in frequency should not necessarily be made after the string trigger switches TSW are rendered ON. For instance, when this invention is applied to an electronic stringed instrument which generates a musical tone at a pitch corresponding to the operated fret position simply by performing a fingering operation even if the string trigger switches TSW are not switched ON, the pitch of the musical tone being currently generated through the fingering operation may be slightly or finely changed in accordance with a slight change in fingering operation position. In addition, the foregoing description of the embodiments has been given with reference to a case where the present invention is applied to an electronic stringed instrument which generates musical tones at pitches designated by the fret switches FSW in association with the ON status of the string trigger switches TSW. The present invention can also be applied to other types of electronic stringed instruments such as an ultrasonic type electronic stringed instrument (disclosed in, for example, U.S. Pat. No. 4,723,468 and the corresponding Published Unexamined Japanese Patent Application Disclosure (KOKAI) No. 62-99790) in which an ultrasonic wave is propagated through a string and the echo time of the ultrasonic wave from the fret position in contact with that string is measured through a fret operation to thereby designate a pitch.

I claim:

1. An electronic musical instrument comprising:

a fingerboard having a fingering operation area over which a player performs a fingering operation;

mode setting means for selectively setting a fret mode for dividing said fingering operation area into a plurality of first pitch designation regions in half-tone pitch units, and a fretless mode for dividing each of said first pitch designation regions into a plurality of second pitch designation regions in pitch units smaller than said half-tone pitch units; and pitch designating means for, when a fingering operation position is changed within a specific first pitch designation region of said plurality of first pitch designation regions in said fret mode set by said mode setting means, designating a same pitch as assigned to said specific first pitch designation region irrespective of a change in fingering operation position, and for, when said fingering operation position is changed to a specific second pitch designation region in said plurality of second pitch designation regions in said fretless mode set by said mode setting means, newly designating a pitch assigned to said specific second pitch designation region in response to a change in fingering operation position.

2. An electronic musical instrument according to claim 1, wherein said fingerboard is provided on an instrument body.

3. An electronic musical instrument according to claim 1, wherein said mode setting means is provided on an instrument body.

4. An electronic musical instrument according to claim 1, wherein at least one string is stretched on said fingerboard.

5. An electronic musical instrument according to claim 1, wherein said fingerboard has a plurality of frets provided thereon as marks for dividing said fingering operation area into a plurality of first pitch designation regions.

6. An electronic musical instrument according to claim 1, further comprising tone generating means for generating a musical tone having a pitch designated by said pitch designating means in response to detection of string vibration.

7. An electronic musical instrument according to claim 6, wherein said tone generating means comprises string vibration detecting means for detecting vibration of at least one string stretched and means for generating a musical tone having a pitch designated by said pitch designating means in response to string vibration detected by said string vibration detecting means.

8. An electronic musical instrument according to claim 6, wherein said tone generating means is provided on an instrument body having said fingerboard.

9. An electronic musical instrument according to claim 1, wherein said pitch designating means comprises a plurality of pitch designation switches provided respectively for said plurality of second pitch designation regions, and means for, when any one of said pitch designation switches is operated, designating a pitch associated with said operated pitch designation switch.

10. An electronic musical instrument comprising:

mode setting means for selectively setting a fret mode and a fretless mode;

position detecting means for detecting a fingering operation position with respect to a fingering operation area; and pitch designating means for, when said position detecting means detects a change in fingering operation position within a specific region of said fingering operation area in said fret mode set by said mode setting means, designating a same pitch as assigned to said specific region irrespective of a change in fingering operation position, and for, when said position detecting means detects a change in fingering operation position within a specific region of said fingering operation area in said fretless mode set by said mode setting means, designating different pitches within a pitch assigned to said specific region in accordance with a degree of said change in fingering operation position.

11. An electronic musical instrument according to claim 10, wherein said fingerboard is provided on an instrument body.

12. An electronic musical instrument according to claim 10, wherein said mode setting means is provided on an instrument body.

13. An electronic musical instrument according to claim 10, wherein at least one string is stretched on said fingerboard.

14. An electronic musical instrument according to claim 10, wherein said fingerboard has a plurality of frets provided thereon as marks for dividing said fingering operation area into a plurality of first pitch designation regions.

15. An electronic musical instrument according to claim 10, further comprising tone generating means for generating a musical tone having a pitch designated by said pitch designating means in response to detection of string vibration.

16. An electronic musical instrument according to claim 15, wherein said tone generating means comprises string vibration detecting means for detecting vibration of at least one string stretched and means for generating a musical tone having a pitch designated by said pitch designating means in response to string vibration detected by said string vibration detecting means.

17. An electronic musical instrument according to claim 15, wherein said tone generating means is provided on an instrument body having said fingerboard.

18. An electronic musical instrument according to claim 10, wherein said first mode is a fret mode, said second mode is a fretless mode, and said predetermined pitch units are half-tone units.

19. An electronic musical instrument according to claim 10, wherein said pitch designating means comprises a plurality of pitch designation switches provided respectively for said plurality of second pitch designation regions, and means for, when any one of said pitch designation switches is operated, designating a pitch associated with said operated pitch designation switch.

20. An electronic musical instrument comprising:

a fingerboard having a fingering operation area over which a player performs a fingering operation;

mode setting means for selectively setting a fret mode for dividing said fingering operation area into a plurality of first pitch designation regions in half-tone pitch units, and a fretless mode for dividing each of said first pitch designation regions into a plurality of second pitch designation regions in pitch units smaller than said half-tone pitch units; and pitch designating means for, when any one of said plurality of first pitch designation regions is subjected to a fingering operation in said fret mode set by said mode setting means, designating a pitch assigned to said first pitch designation region subjected to said fingering operation, and for, when any one of said plurality of second pitch designation regions is subjected to a fingering operation in said fretless mode set by said mode setting means, designating a pitch assigned to said second pitch designation region subjected to said fingering operation.

21. An electronic musical instrument according to claim 20, wherein said fingerboard is provided on an instrument body.

22. An electronic musical instrument according to claim 20, wherein said mode setting means is provided on an instrument body.

23. An electronic musical instrument according to claim 20, wherein at least one string is stretched on said fingerboard.

24. An electronic musical instrument according to claim 20, wherein said fingerboard has a plurality of frets provided thereon as marks for dividing said fingering operation area into a plurality of first pitch designation regions.

25. An electronic musical instrument according to claim 20, further comprising tone generating means for generating a musical tone having a pitch designated by said pitch designating means in response to detection of string vibration.

26. An electronic musical instrument according to claim 25, wherein said tone generating means comprises string vibration detecting means for detecting vibration of at least one string stretched and means for generating a musical tone having a pitch designated by said pitch designating means in response to string vibration detected by said string vibration detecting means.

27. An electronic musical instrument according to claim 25, wherein said tone generating means is provided on an instrument body having said fingerboard.

* * * * *